US011549779B2

(12) United States Patent
Chapin et al.

(10) Patent No.: US 11,549,779 B2
(45) Date of Patent: Jan. 10, 2023

(54) DEVICE FOR DEPLOYING A DEPLOYABLE ELEMENT, IN PARTICULAR A HANDLE, FOR A WEAPON SYSTEM

(71) Applicant: MBDA FRANCE, Le Plessis-Robinson (FR)

(72) Inventors: Lucas Chapin, Le Plessis-Robinson (FR); Grégory Cesar, Le Plessis-Robinson (FR); Clyde Laheyne, Le Plessis-Robinson (FR)

(73) Assignee: MBDA France, Le Plessis-Robinson (FR)

( * ) Notice: Subject to any disclaimer, the term of this patent is extended or adjusted under 35 U.S.C. 154(b) by 46 days.

(21) Appl. No.: 17/292,853

(22) PCT Filed: Nov. 6, 2019

(86) PCT No.: PCT/FR2019/052639
§ 371 (c)(1),
(2) Date: May 11, 2021

(87) PCT Pub. No.: WO2020/109686
PCT Pub. Date: Jun. 4, 2020

(65) Prior Publication Data

US 2021/0396487 A1 Dec. 23, 2021

(30) Foreign Application Priority Data

Nov. 28, 2018 (FR) ..... 1871885

(51) Int. Cl.
*F41C 23/04* (2006.01)
*F41C 23/16* (2006.01)

(52) U.S. Cl.
CPC ..... *F41C 23/04* (2013.01); *F41C 23/16* (2013.01)

(58) Field of Classification Search
CPC ..... F41C 23/04; F41C 23/16; F16M 11/16; F16M 11/28; F16M 11/42;
(Continued)

(56) References Cited

U.S. PATENT DOCUMENTS 601,840 A * 4/1898 Harris ..... F41A 9/18 42/17
1,340,996 A * 5/1920 Williams ..... F41G 1/26 42/137

(Continued)

FOREIGN PATENT DOCUMENTS

WO WO 2009/009663 A2 1/2009

OTHER PUBLICATIONS

International Searching Authority, International Search Report (ISR) and Written Opinion received for International Application No. PCT/FR2019/052639, dated Mar. 2, 2020, 13 pages, European Patent Office, Netherlands.

(Continued)

*Primary Examiner* — Michael D David
(74) *Attorney, Agent, or Firm* — Alston & Bird LLP

(57) ABSTRACT

The deployment device may include a support piece, the deployable element, in particular a handle, may be rotatably mounted on said support piece and being connected by means of an elastic element to the support piece. The deployable element may include at least one pin capable of being moved along a curved guide of the support piece and adopting one or both of the two stable positions, respectively, in two housings provided in the support piece. The stable positions may respectively correspond to a stowed position and a deployed position of the deployable element. The guide and the elastic element may be configured to generate an automatic deployment of the deployable element to the deployed position as soon as the deployable element (Continued)

is subjected by an operator to a rotation having an angle greater than or equal to an unlocking angle.

14 Claims, 4 Drawing Sheets

(58) Field of Classification Search
CPC .... F16M 2200/08; F21L 14/04; F21V 17/007; F21V 21/06; F21V 21/40; F21W 2131/1005
USPC ..... 42/137, 17, 65, 69.03, 94; 248/122.1, 248/157, 205.1; 362/362, 190
See application file for complete search history.

(56) References Cited

U.S. PATENT DOCUMENTS

| | | | | |
|---|---|---|---|---|
| 3,327,422 | A | 6/1967 | Harris | |
| 6,571,502 | B1 * | 6/2003 | Mikuta | F41A 19/70 42/84 |
| 2009/0284963 | A1 | 11/2009 | Intravatola | |
| 2018/0023912 | A1 * | 1/2018 | Cudazzo | F41A 5/02 89/136 |

OTHER PUBLICATIONS

National Industrial Property Institute, Preliminary Search Report (PSR) and Written Opinion received for Application No. FR1871885, dated Oct. 15, 2019, 8 pages, Republic of France.

* cited by examiner

DEVICE FOR DEPLOYING A DEPLOYABLE ELEMENT, IN PARTICULAR A HANDLE, FOR A WEAPON SYSTEM

CROSS-REFERENCE TO RELATED APPLICATIONS

This application is a national stage application filed under 35 U.S.C. § 371 of International Application No. PCT/FR2019/052639 filed Nov. 6, 2019, which application claims priority to French Patent Application No. 1871885, filed Nov. 28, 2018, each of the foregoing applications is hereby incorporated by reference in its entirety.

TECHNICAL FIELD

The present invention relates to a device for deploying a deployable element for a weapon system.

BACKGROUND

More particularly, although not exclusively, the present invention applies to a weapon system, in particular to a mobile firing station, especially of the shoulder-carried type, such as a missile launcher or a rocket launcher, which requires a quick grip, by the deployment of a gripping element, such as a handle for example.

A handle of such a weapon system takes up a certain amount of space. Also, in order to reduce this bulk, in particular when storing and transporting the weapon system when it is not in use, it is known to provide a handle which is folded in this situation, while being deployable. Such a deployable handle is capable of being brought from the stowed position to a stable deployed position for its use and the gripping of the weapon system.

In order to implement this deployment, a device is known with which an operator must perform the following operations: pressing a button to unlock the movement of the handle which is initially locked in the stowed position, then moving the handle, in particular by rotation, to bring it into the deployed position, and finally locking it in this deployed position before it can be used.

This usual deployment solution therefore requires a relatively large amount of operator intervention and does not allow a very rapid deployment.

This usual deployment solution is therefore not completely satisfactory.

DESCRIPTION OF THE INVENTION

The purpose of the present invention is to remedy this drawback. It relates to a device for deploying a deployable (or able to be deployed) element for a weapon system, allowing to implement a rapid deployment, at least partially automatic, with a reduced intervention of an operator.

According to the invention, said deployment device comprises a support piece, the deployable element is rotatably mounted on said support piece and is connected by means of at least one elastic element to said support piece, said deployable element comprises at least one pin, said pin being able to move along a curved guide of the support piece and to adopt one or the other of two stable positions respectively in two housings provided in the support piece, these stable positions respectively corresponding to a stowed position and a deployed position of the deployable element, and at least said guide and said elastic element are configured to generate an automatic deployment of the deployable element to said deployed position as soon as the deployable element is subjected to a rotation (from the stowed position to the deployed position), the angle of which is greater than or equal to a so-called unlocking angle.

Thus, thanks to the invention, as soon as the deployable element is rotated (by an operator) from the stowed position, by an angle corresponding to said unlocking angle, the rest of the deployment to said deployed position (i.e. a substantial part of the deployment) is performed automatically. Furthermore, as this deployed position (reached at the end of the automatic deployment) is stable, no final locking is required.

Therefore, said deployment device allows a rapid deployment of the deployment element, for example a handle of a missile launcher, with a reduced operator intervention (consisting of simply bringing the deployable element beyond said locking angle) and a partially automatic deployment.

Said deployment device also has other advantages. In particular, as further specified below, it allows in particular to hold logistic load cases and to take up all transverse efforts in use, and it comprises a reduced number of components.

In a preferred embodiment, to generate the automatic deployment, said guide and said elastic element are configured so that the force of the deployable element on the support piece, generated by the elastic element, is located outside a friction cone created at the point of contact between the deployable element and the support piece, i.e. at the point of contact of the pin on the curved guide.

Advantageously, to generate said automatic deployment, at least said guide and said elastic element are configured so that the following inequation is satisfied:

$$N.\beta<\alpha$$

inequation in which:

- $\beta$ is the angular value of the friction cone with respect to its generatrix;
- $\alpha$ is the angle between said force of the deployable element on the support piece, generated by the elastic element, and the generatrix of said friction cone; and
- N is a safety coefficient, greater than 1.

Furthermore, advantageously, the deployable element comprises two pins arranged on either side of said deployable element, the support piece comprises two curved guides, and each of said pins is able to move along one of said curved guides of the support piece.

Furthermore, advantageously, the curved guide or the curved guides have a shape in the form of a circular arc between said two housings (defining the stable positions).

Furthermore, advantageously, said deployable element is provided with at least one oblong slot, in which is mounted a peg fixed to the support piece, to allow the rotation of the deployable element on said support piece. Preferably, said deployable element is provided with two oblong slots, in each of which is mounted each time a peg fixed to the support piece. Furthermore, advantageously, the support piece is provided with spring blades at the peg or the pegs.

Furthermore, advantageously, said deployable element comprises a bevel between an end of the oblong slot and an edge of said deployable element.

Furthermore, advantageously, said pin is a projecting element whose peripheral edge comprises a substantially semi-circular section.

Within the scope of the present invention, said deployment device may be applied to any type of mechanical element to be deployed (manually in the prior art) on a weapon system. In a preferred embodiment, said deployable element corresponds to one of the following elements: a gripping element such as a handle in particular, a stop, an aiming system.

The present invention also relates to a weapon system, which comprises at least one deployable element and at least one device for deploying said deployable element, such as the one described above.

The present invention may be applied to various weapon systems, and more particularly although not exclusively to mobile, especially handheld, weapon systems.

In a preferred application, the weapon system corresponds to a missile launcher or a rocket launcher and/or said deployable element corresponds to one of the following elements of this weapon system: a gripping element such as a handle in particular, a stop, an aiming system, preferably with a handle.

BRIEF DESCRIPTION OF FIGURES

The attached figures will make it clear how the invention can be implemented. In these figures, identical references designate similar elements.

DETAILED DESCRIPTION

Figure 1:
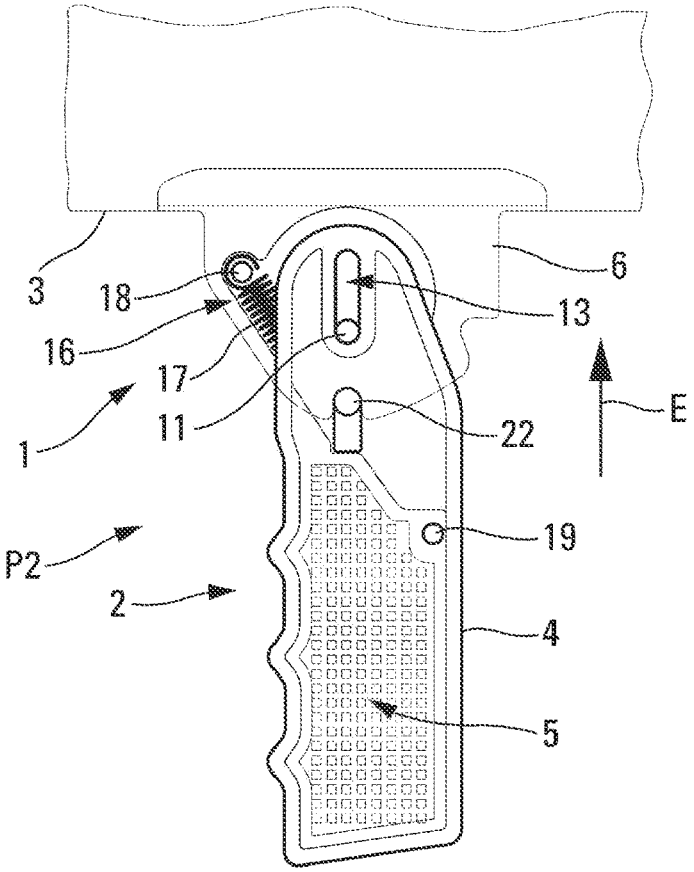
FIG. 1 is a side view of a particular embodiment of a device for deploying a deployable element corresponding to a handle.

The device 1 illustrating the invention and shown in FIG. 1 is a device for deploying a deployable element 2 (i.e. an element capable of being deployed or intended to be deployed) for a weapon system 3, of which only a small part has been very schematically shown in FIG. 1.

The present invention can be applied to various weapon systems, and in particular to portable weapon systems, which require the deployment of a deployable element 2, and this in particular during its use.

In a preferred embodiment, the weapon system 3 corresponds to a rocket launcher or a missile launcher, in particular an anti-tank missile or a short-range anti-aircraft missile. Furthermore, the deployable element 2 corresponds, for example, to one of the following elements of this weapon system: a gripping element such as a handle in particular, a stop, an aiming system, for example a sight.

In the example described below, with reference to FIGS. 1 to 9, the deployable element 2 is a handle 4. The deployable handle 4 comprises a usual grip (or handling) area 5, which is suitable for being gripped by an operator (not shown), in particular the operator planning to operate the weapon system 3.

Said deployment device 1 also comprises, as shown in FIG. 1, a support piece 6.

This support piece 6 may be either a part of the weapon system 3 or an independent piece that is intended to be fixed to the weapon system 3 by a usual fixing means.

Figure 2:
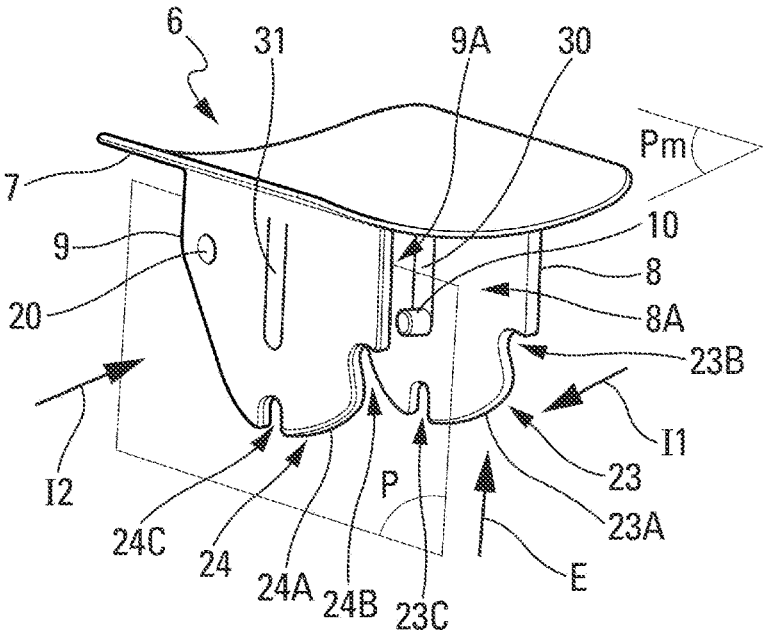
FIG. 2 is a perspective view of a support piece of the deployment device of FIG. 1.

As shown in FIG. 2, the support piece 6 comprises a plate 7 slightly inclined at its centre with respect to a mean plane Pm. The mean plane Pm of the plate 7 is orthogonal to a plane of symmetry P corresponding to a plane of symmetry of the deployment device 1. The support piece 6 is also provided with two substantially flat lateral legs 8 and 9, arranged substantially parallel to the plane of symmetry P, symmetrically with respect to this plane of symmetry P, on either side of the latter. The support piece 6 thus has a general staple shape. The plate 7 may be attached to a part of the weapon system 3 or correspond to a part of the latter.

The deployable element 2 is mounted on the support piece 6 in such a way that it can pivot. For this purpose, the support piece 6 comprises two pegs 10 and 11 (FIGS. 1 and 2) each mounted on one of said legs 8 and 9, respectively on the inner face 8A, 9A of these legs 8 and 9.

In FIGS. 1, and 7 to 9, the support piece 6 (visible in its details in FIG. 2) is shown in thin line to illustrate a transparency allowing to see the details of the deployable element 2 mounted on this support piece 6, in order to simplify the understanding of the deployment device 1.

In the following description, the adjective internal is determined towards the plane of symmetry P, on either side of said plane of symmetry P, as illustrated by arrows I1 and I2 in FIG. 2, and the adjective external is defined in the opposite direction. Furthermore, the adjective upper is determined according to the direction (illustrated by an arrow E in FIGS. 1 to 3) of the deployable element 2 towards the support piece 6, and the adjective lower is determined according to the direction opposite to the direction E.

In the assembled position of FIG. 1, the pegs 10 and 11 are inserted in oblong slots 12 and 13. Each of said oblong slots 12 and 13 is made in an upper part of a leg 14, 15 of the deployable element 2. The two substantially flat legs 14 and 15 are provided, on either side of the plane of symmetry P, at the upper part of the deployable element 2, as shown in FIGS. 3 and 4.

The mounting of the pegs 10 and 11 (fixed to the support piece 6) in the two oblong slots 12 and 13 (of the deployable element 2) allows the rotation of the deployable element 2 with respect to said support piece 6.

Furthermore, the deployable element 2 is connected via at least one elastic element 16 to said support piece 6. In the example shown in the figures, the elastic element 16 is a spring 17. This spring 17 comprises a loop 17A, 17B at each of its longitudinal ends, as shown in particular in FIGS. 5 and 6. These loops 17A and 17B surround dowel pins 18 and 19. The dowel pin 18 is inserted into holes 20 (FIG. 2) made in the support piece 6, and the dowel pin 19 is inserted into holes 21 (FIG. 3) made in the deployable element 2.

Figure 3:
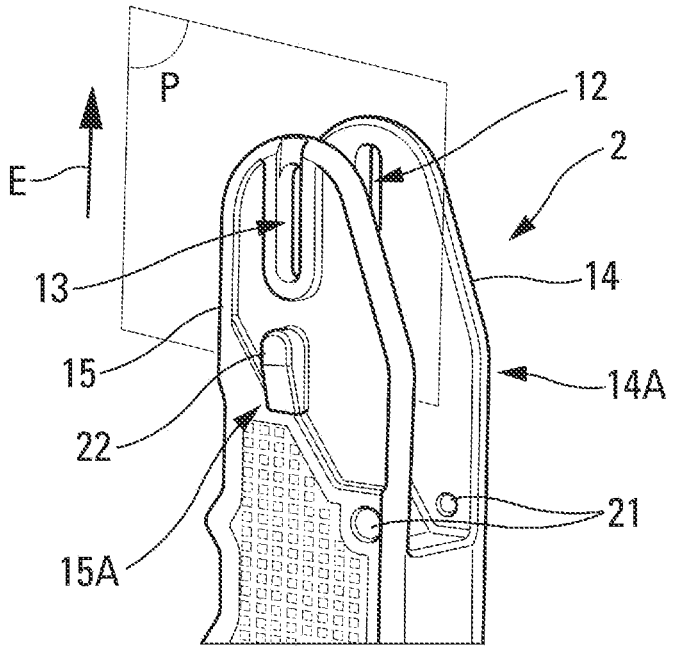
FIG. 3 is a partial perspective view of an upper part of a handle able to be deployed by the deployment device of FIG. 1.
Figure 4:
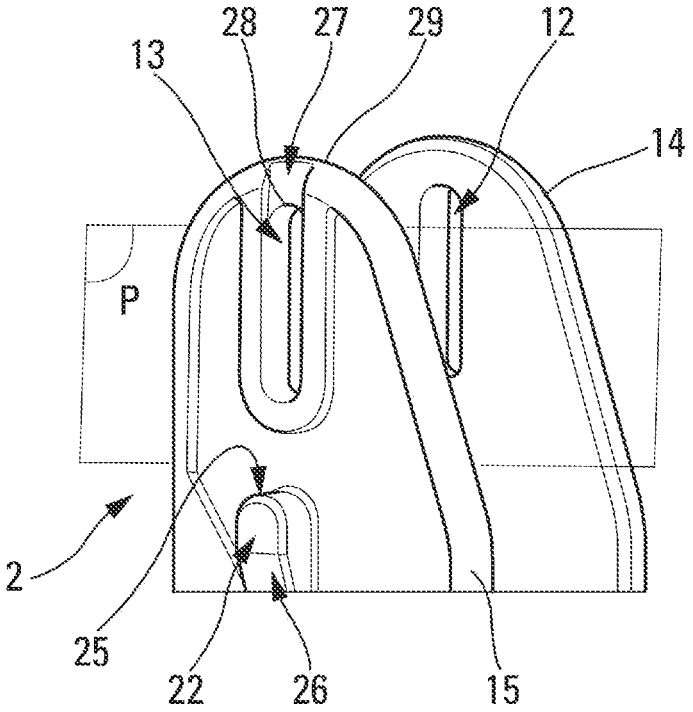
FIG. 4 is an enlarged schematic perspective view of an upper part of the view in FIG. 3.

Furthermore, the deployable element 2 comprises two pins 22 shown in FIGS. 1, 3 and 4, which are arranged on either side of the deployable element 2, on the outer faces 14A and 15A (FIG. 3) of the legs 14 and 15 of the deployable element 2. Only the pin 22 of the leg 15 is visible in these FIGS. 1, 3 and 4.

The support piece 6 furthermore comprises two curved guides 23 and 24. The curved guides 23 and 24 represent, respectively, sections of a part of the peripheral edge of the legs 8 and 9 of the support piece 6, as shown in FIG. 2.

Each of the curved guides 23 and 24 comprises a part 23A, 24A having a circular arc shape. This part 23A, 24A is defined between two housings, one housing 23B, 24B and one housing 23C, 24C. These housings 23B, 24B, 23C, 24C correspond to rounded recesses made in the peripheral edge of the legs 8 and 9, on either side of the circular arc part 23A, 24A.

Each pin 22 is able to move along the associated curved guide 23, 24 of the support piece 6 and to adopt one or the other of two stable positions, respectively, in the one or the other of the two housings (housing 23B, 24B on the one hand and housing 23C, 24C on the other hand) provided in the support piece 6.

These stable positions correspond, respectively, to a stowed position P1 (FIG. 7) and to a deployed position P2 (FIG. 9) of the deployable element 2.

In a particular embodiment, the support piece 6 is provided with spring blades 30 and 31 at the pegs 10 and 11, as shown in FIG. 2. Each spring blade 30 and 31 is formed in a leg 8, 9 of the support piece 6. These spring blades 30 and 31 allow to facilitate the insertion of the pegs 10 and 11 (which can thus be pushed slightly outwards) into the oblong slots 12 and 13 of the support piece 6, and thus to facilitate the mounting of the deployable element 2 on the support piece 6.

Furthermore, as shown in FIG. 4, the deployable element 2 comprises, on each of the legs 14 and 15, a bevel 27 between an upper end 28 of the oblong slot 12, 13 and an upper edge 29 of the deployable element 2. These bevels 27, only one of which is visible in FIG. 4, also allow to facilitate the insertion of the pegs 10 and 11 into the oblong slots 12 and 13 and thus the mounting of the deployable element 2 on the support piece 6.

Furthermore, in the particular embodiment shown in FIG. 4, each pin 22 is a projecting element, the upper peripheral edge of which comprises a substantially semi-circular section 25. The remainder of its peripheral edge is not a circular arc, and is provided with a bevelled area 26. Of course, each pin 22 may also simply correspond to a projecting cylindrical section.

Figure 7:
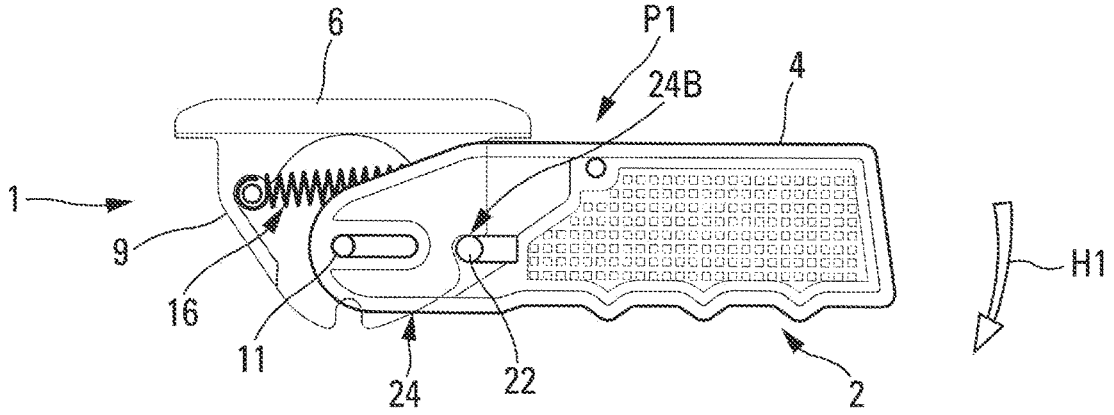
FIG. 7 is a side view of the deployment device in a stowed position of the handle, illustrating an initial step of a deployment.
Figure 8:
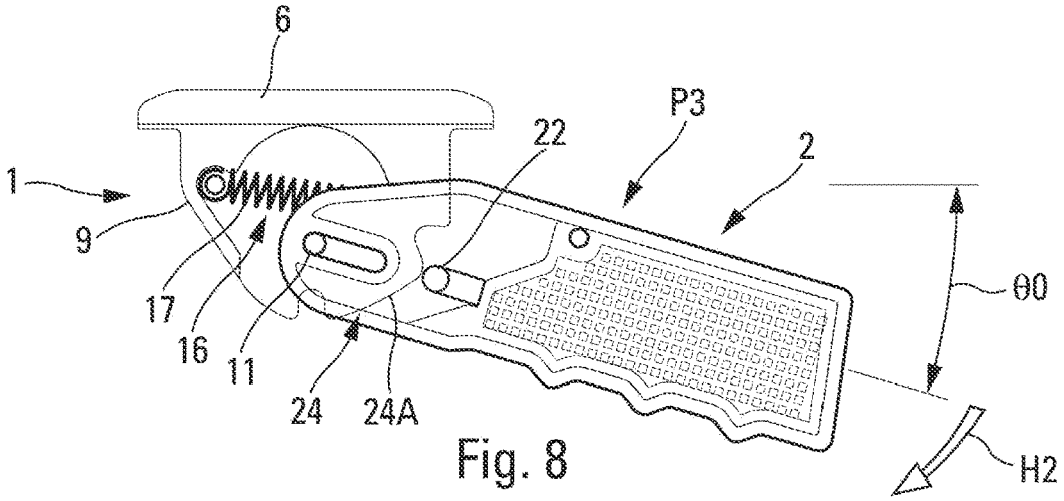
FIG. 8 is a figure similar to FIG. 7, illustrating an intermediate step of the deployment.
Figure 9:
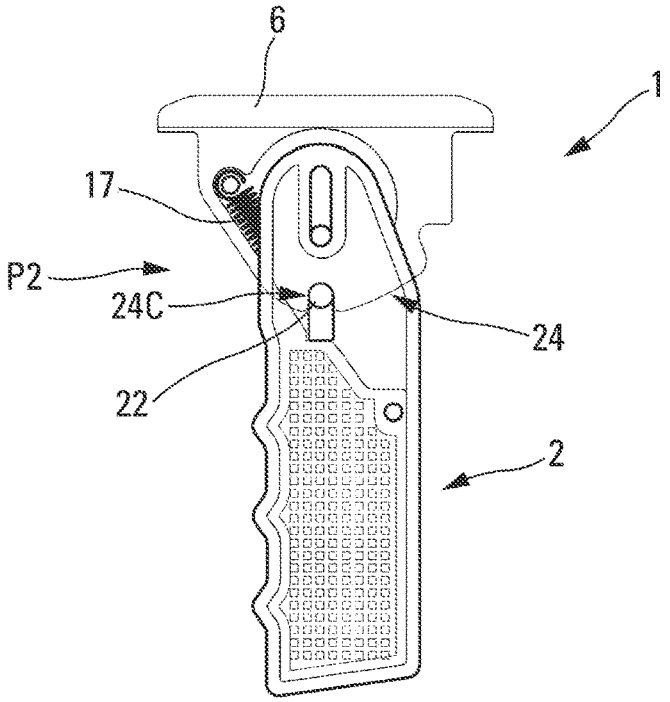
FIG. 9 is a figure similar to FIGS. 7 and 8, illustrating a final step of the deployment.

The deployment device 1, and in particular at least said curved guide 23, 24 and said elastic element 16 are configured (i.e. formed and arranged) in such a way as to generate an automatic deployment of the deployable element 2 up to said deployed position P2 (FIG. 9), and this as soon as the deployable element 2 is subjected in the direction illustrated by an arrow H1 in FIG. 7 (from the stowed position P1 to the deployed position P2), to a rotation whose angle is greater than or equal to an unlocking angle θ0 (FIG. 8). This rotation (or pivoting) is generated by an operator pressing, preferably manually, on the deployable element 2 in the direction illustrated by the arrow H1 in FIG. 7. The unlocking angle θ0 defines an unlocking position P3 (shown in FIG. 8) of the deployable element 2. From this unlocking position P3, the end of the deployment to the deployed position P2 of FIG. 9 is performed automatically, in the direction illustrated by an arrow H2 in FIG. 8.

Figure 5:
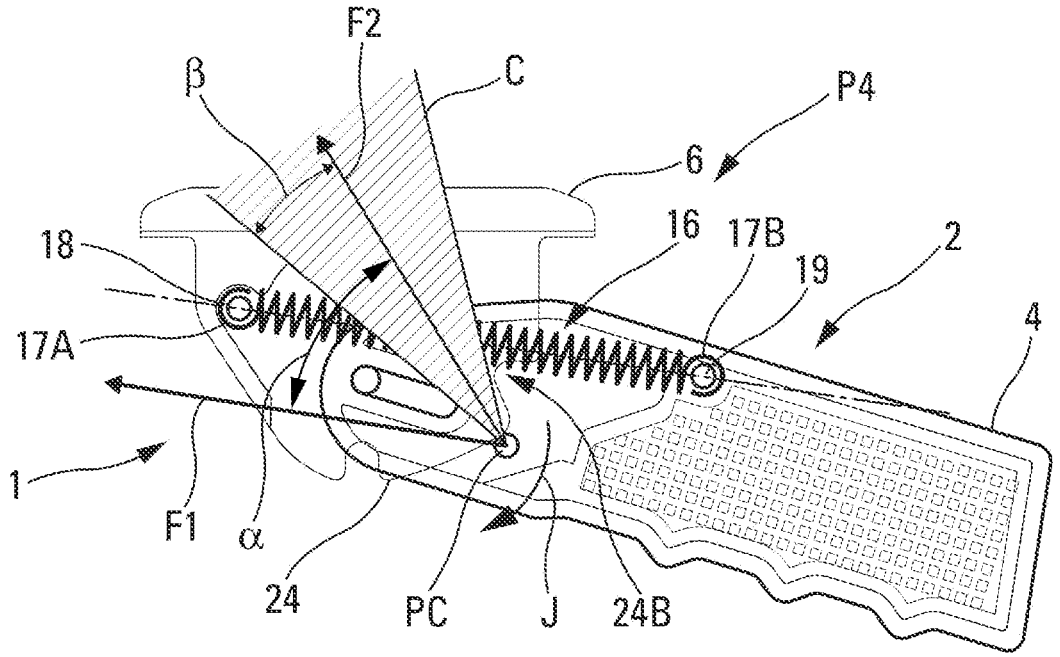
FIG. 5 is a schematic view of the deployment device of FIG. 1 during deployment to explain the operation of the automatic deployment.
Figure 6:
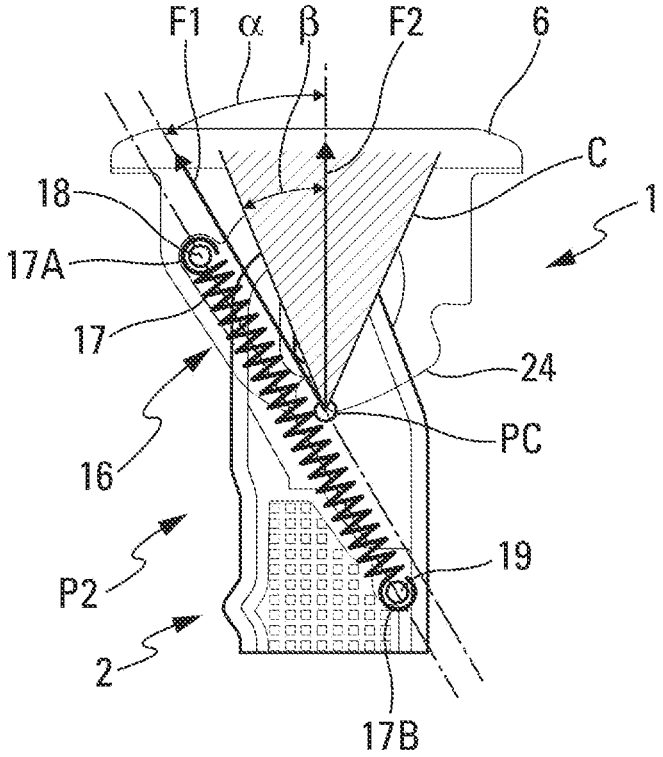
FIG. 6 is a schematic view of the deployment device of FIG. 1 in a deployed position, to explain the operation of the automatic deployment in relation to FIG. 5.

In a preferred embodiment, in order to generate the automatic deployment from the unlocking position P3 to the deployed position P2, the deployment device 1, and in particular the curved guides 23 and 24 and the elastic element 16, are configured so that the force F1 of the deployable element 2 on the support piece 6, which is generated by the elastic element 16, is always located outside a friction cone C, as shown in FIGS. 5 and 6 respectively in an intermediate position P4 (corresponding, for example, to the unlocked position) and in the deployed position P2.

This friction cone C is created, in the usual way, at the point of contact PC between the deployable element 2 and the support piece 6, i.e. at the point of contact of each pin 22 on the associated curved guide 23, 24. This point of contact PC therefore moves during the rotation of the deployable element 2 with respect to the support piece 6, as illustrated by an arrow J in FIG. 5. The friction cone C has a generatrix F2 which is defined along a direction normal to the tangent of the curve (of the curved guide 23, 24) at the point of contact PC. The friction cone C has an angle β with respect to the generatrix F2. As for the force F1, it is defined from the point of contact PC parallel to the direction of the elastic element 16 (spring 17).

More precisely, to generate the automatic deployment, the deployment device 1 and in particular the curved guides 23 and 24 and the elastic element 16 are configured so that the following inequation always is satisfied: $N.\beta<\alpha$, In this inequation, α (FIG. 6) is the angle between, on the one hand, said force F1 of the deployable element 2 on the support piece 6, generated by the elastic element 16, and, on the other hand, the generatrix F2 of said friction cone C. Furthermore, N is a safety coefficient which is greater than 1.

The operation of the deployment device 1, as described above, is as follows.

With the deployable element 2, namely the handle 4, in the stowed state P1, as shown in FIG. 7, an operator pushes or pulls the deployable element 2 in the direction illustrated by the arrow H1. As soon as the deployable element 2 passes the unlocking position P3, shown in FIG. 8, the deployment device 1 generates an automatic deployment of the deployable element 2 in the direction shown by the arrow H2, until bringing it to the deployed position P2 shown in FIG. 9.

Moreover, as in this deployed position P2 the pin 22 is located in the housing 24C, the deployed position P2 is stable and no final locking is required.

Thus, as soon as the deployable element 2 is pivoted (by an operator) from the stowed position P1, by an angle corresponding to said unlocking angle θ0, the rest of the deployment to said deployed position P2 (namely a very important part of the deployment) is performed automatically.

In the scope of the present invention, deployment means the displacement, by pivoting (or rotation through an circular arc) of the deployable element 2, from the stowed position P1 to the deployed position P2. Of course, after use, the deployable element 2 can be returned by an operator from the deployed position P2 to the stowed position P1, in particular for transporting the weapon system.

Therefore, said deployment device 1 generates a quick deployment of the deployment element 2, for example a handle 4, with reduced operator intervention (consisting simply in bringing the deployable element beyond said locking angle) and a partially automatic deployment.

The deployment device 1 thus allows for a quick grip of the weapon system 3, for example a mobile firing station carried to the shoulder or any other element requiring the integration of a quick and space-saving grip.

The deployment device 1 also allows to perform an automatic positioning of the deployable element 2, in the deployed position P2, in which the weapon system 3 will be used, with a reduction in the number of movements of the operator using it.

In addition, the deployment device 1 allows, by its design, to take up all (transverse) efforts on the plane normal to the axis of the deployable element 2, during its use.

Furthermore, thanks to its stowed position P1, which is stable, due in particular to the arrangement of the pins 22 in the housings 23B and 24B, the deployment device 1 enables to block the deployable element 2 in the event of shocks, so as to avoid an unintentional deployment.

It can therefore withstand loads, particularly during the logistical phase (storage and transport of the weapon system). This enables to prevent the deployment under a certain amount of stress in the logistics phase.

Furthermore, the number of components of the deployment device 1 is reduced by more than 50% compared to a conventional device. This reduction in the number of components also reduces the cost of the deployment device 1.

The invention claimed is:

1. A device for deploying a deployable element for a weapon system, wherein the device comprises a support piece, in that the deployable element is rotatably mounted on said support piece and is connected by means of at least one elastic element to said support piece, in that said deployable element comprises at least one pin, said pin being able to move along a curved guide of the support piece and to adopt one or the other of two stable positions respectively in two housings provided in the support piece, these stable positions respectively corresponding to a stowed position and a deployed position of the deployable element, and in that at least said guide and said elastic element are configured to generate an automatic deployment of the deployable element to said deployed position as soon as the deployable element is subjected to a rotation, from the stowed position to the deployed position, the angle of which is greater than or equal to an unlocking angle.

2. The device according to claim 1, wherein, to generate the automatic deployment, said guide and said elastic element are configured so that the force of the deployable element on the support piece, generated by the elastic element, is located outside a friction cone created at the point of contact between the deployable element and the support piece.

3. The device according to claim 2, wherein, to generate the automatic deployment, at least said guide and said elastic element are configured so that the following inequation is satisfied:

$$N.\beta<\alpha$$

inequation in which:

$\beta$ is the angular value of the friction cone with respect to its generatrix;

$\alpha$ is the angle between said force of the deployable element on the support piece, generated by the elastic element, and the generatrix of said friction cone; and N is a safety coefficient, greater than 1.

4. The device according to claim 1, wherein the deployable element comprises two pins arranged on either side of said deployable element, in that the support piece comprises two curved guides, and in that each of said pins is able to move along one of said curved guides of the support piece.

5. The device according to claim 1, wherein the curved guide or the curved guides have a shape in the form of a circular arc between said housings.

6. The device according to claim 1, wherein said deployable element is provided with at least one oblong slot, in which is mounted a peg fixed to the support piece, to allow the rotation of the deployable element on said support piece.

7. The device according to claim 6, wherein said deployable element is provided with two oblong slots, in each of which is mounted each time a peg fixed to the support piece.

8. The device according to claim 6, wherein the support piece is provided with spring blades at the peg or the pegs.

9. The device according to claim 1, wherein said deployable element comprises a bevel between an end of the oblong slot and an edge of said deployable element.

10. The device according to claim 1, wherein said pin is a projecting element whose peripheral edge comprises a substantially semi-circular section.

11. The device according to claim 1, wherein said deployable element corresponds to one of the following elements: a gripping element, a stop, an aiming system.

12. A weapon system, wherein the weapon system comprises at least one deployable element and at least one device for deploying said deployable element, according to claim 1.

13. The weapon system according to claim 12, wherein the weapon system corresponds to one of the following: a missile launcher, a rocket launcher.

14. The weapon system according to claim 12, wherein said deployable element corresponds to one of the following elements of the weapon system: a gripping element, a stop, an aiming system.

* * * * *